US007523947B2

(12) United States Patent
Pham et al.

(10) Patent No.: US 7,523,947 B2
(45) Date of Patent: Apr. 28, 2009

(54) SKATE CHASSIS WITH PITCH ADJUSTMENT

(75) Inventors: Tan Pham, Garden Grove, CA (US); Thomas V. Wilder, Laguna Niguel, CA (US); Robert W. McLean, Phoenix, AZ (US)

(73) Assignee: Mission ITech Hockey, Inc, Irvine, CA (US)

( * ) Notice: Subject to any disclaimer, the term of this patent is extended or adjusted under 35 U.S.C. 154(b) by 944 days.

(21) Appl. No.: 11/052,531

(22) Filed: Feb. 7, 2005

(65) Prior Publication Data

US 2005/0212227 A1 Sep. 29, 2005

Related U.S. Application Data

(63) Continuation of application No. 10/188,151, filed on Jul. 1, 2002, now Pat. No. 6,851,680.

(60) Provisional application No. 60/302,423, filed on Jun. 29, 2001, provisional application No. 60/333,903, filed on Nov. 27, 2001.

(30) Foreign Application Priority Data

Jul. 1, 2002 (WO) ..... PCT/US02/20943

(51) Int. Cl.

| | |
|---|---|
| ***A63C 1/00*** | (2006.01) |
| ***A63C 1/30*** | (2006.01) |
| ***A63C 17/00*** | (2006.01) |
| ***A63C 17/18*** | (2006.01) |
| ***A63C 17/02*** | (2006.01) |
| ***A63C 17/04*** | (2006.01) |
| ***A63C 3/00*** | (2006.01) |

(52) U.S. Cl. ..... 280/11.12; 280/11.18; 280/11.17; 280/11.3; 280/11.31; 280/11.32; 280/11.34; 280/11.27; 280/7.13; 280/841; 280/11.223

(58) Field of Classification Search ..... 280/11.12, 280/11.18, 11.17, 11.3, 11.31, 11.32, 11.34, 280/11.27, 7.13, 841, 11.223

See application file for complete search history.

(56) References Cited

U.S. PATENT DOCUMENTS

| | | | |
|---|---|---|---|
| 36,244 | A | 8/1862 | Starr |
| 475,650 | A | 5/1892 | Wierda |
| 577,027 | A | 2/1897 | Heinze |
| 601,013 | A | 3/1898 | Evans |
| 609,401 | A | 8/1898 | Beisel |

(Continued)

FOREIGN PATENT DOCUMENTS

| | | | |
|---|---|---|---|
| EP | 0 623 369 | A1 | 5/1993 |

(Continued)

*Primary Examiner*—Christopher P Ellis
*Assistant Examiner*—John R Olszewski
(74) *Attorney, Agent, or Firm*—Knobbe, Martens, Olson & Bear, LLP

(57) ABSTRACT

An ice skate chassis is configured so that a user can adjust the pitch of the skate chassis between a plurality of discrete pitch positions. The pitch is adjusted by locking the ice blade at a desired angle relative to a bladeholder of the chassis. The blade can be positively locked at a plurality of discrete, repeatable angle positions so that the angle will not slip or creep during skating.

28 Claims, 13 Drawing Sheets

U.S. PATENT DOCUMENTS

| | | | |
|---|---|---|---|
| 1,097,875 | A | 5/1914 | Pierce |
| 1,228,544 | A | 6/1917 | Falstrem et al. |
| 1,603,588 | A | 10/1926 | Eberle |
| 1,702,316 | A | 2/1929 | Ridgers |
| 1,751,692 | A | 3/1930 | Frubeis |
| 1,789,182 | A | 1/1931 | Klevstad |
| 3,988,124 | A | 10/1976 | Babcock |
| 4,076,263 | A | 2/1978 | Rand |
| 4,126,323 | A | 11/1978 | Scherz |
| 4,139,209 | A | 2/1979 | Humphreys |
| 4,161,822 | A | 7/1979 | Ayvazian |
| 4,218,069 | A | 8/1980 | Baikie |
| 5,257,793 | A | 11/1993 | Fortin |
| 5,366,232 | A | 11/1994 | Pozzobon et al. |
| 5,513,862 | A | 5/1996 | Chuang |
| 5,580,070 | A | 12/1996 | Bekessy |
| 5,634,648 | A | 6/1997 | Tonel et al. |
| 5,690,344 | A | 11/1997 | Chen |
| 5,890,724 | A | 4/1999 | Gignoux et al. |
| 5,957,470 | A | 9/1999 | Powell |
| 5,979,916 | A | 11/1999 | Gatel et al. |
| 6,419,241 | B1 | 7/2002 | Chenevert |
| 6,478,313 | B1 | 11/2002 | Gray |
| 6,485,033 | B2 | 11/2002 | Nicoletti et al. |
| 6,523,835 | B1 | 2/2003 | Lyden |

FOREIGN PATENT DOCUMENTS

| | | |
|---|---|---|
| NL | 1013912 | 12/1999 |

SKATE CHASSIS WITH PITCH ADJUSTMENT

RELATED APPLICATIONS

This application is a continuation of U.S. application Ser. No. 10/188,151, filed Jul. 1, 2002 now U.S. Pat. No. 6,851,68, which claims priority to U.S. Provisional Application No. 60/302,423, filed Jun. 29, 2001, and U.S. Provisional Application No. 60/333,903, filed Nov. 27, 2001. Each of these applications is hereby incorporated by reference in its entirety.

FIELD OF THE INVENTION

The present invention is in the field of skate chassis for ice or roller skating. More particularly, the present invention relates to a skate chassis having adjustable pitch.

BACKGROUND OF THE INVENTION

Ice and roller skates typically include a boot and a chassis. The chassis is mounted to a sole of the boot and is adapted to engage a surface on which the wearer is skating. In rollerskates, the chassis typically supports a plurality of wheels which engage the ground. In ice skates, the chassis typically includes a blade or runner that engages an ice surface.

Skates are typically configured so that a center of gravity of the skater is disposed generally centrally along the length of the skate chassis. This skate configuration is generally referred to as a neutral pitch. As skaters become more advanced, they may desire to vary the skate pitch to accommodate a preferred skating style. In fact, for specialized skating activities, skates having a non-neutral pitch may be desired so as to shift the skaters' center of gravity forwardly (forward pitch) or rearwardly (rearward pitch) relative to a typical neutral pitch skate.

For example, in hockey, offensive players tend to desire increased sprinting speed, and thus desire a skate having a forward pitch, which leans the skate forwardly and correspondingly places their center of gravity forwardly. Defensive players, on the other hand, tend to desire ease and speed when skating backwardly. Thus, defensive players tend to desire a skate having a rearward pitch, which leans the skate rearwardly and correspondingly shifts the skater's center of gravity rearwardly.

In the past, accommodating an ice skater's desire for forward or rearward pitch has necessitated customizing the runner to a specific pitch. This typically involves grinding away relatively large portions of a standard ice skate blade so that the ice skate has an overall pitch as desired by the skater. The grinding process is time consuming, expensive, and leaves room for significant errors and inconsistencies. Such inconsistencies can negatively affect a skater's performance. For example, inconsistencies between a matched pair of ice blades could disrupt the skater's balance. Further, precisely duplicating a specific grinding pattern can be difficult. Accordingly, each time a skater installs a replacement blade, the blade likely will vary somewhat from the previous blade, and the skater will require time and practice to become accustomed to the replacement blade.

Some skaters may play multiple positions in hockey or may prefer different skate pitch configurations for varying conditions. However, once an ice blade has been custom-ground to a specific configuration, it is not adjustable to other configurations. Thus, to accommodate a skater's changing preferences in ice skate pitch, the player must have multiple sets of ice blades in order to match each preferred pitch configuration.

SUMMARY OF THE INVENTION

Accordingly, there is a need in the art for a skate chassis having a variable pitch which can be easily and predictably adjusted.

In accordance with one aspect, the present invention provdes an inline or ice skate chassis. The chassis includes a shoe-engaging portion attached to a surface-engaging portion. The surface-engaging portion may be secured to the shoe-engaging portion at a plurality of discrete positions. The surface-engaging portion is at a different angle relative to the shoe-engaging portion at each of the discrete positions, thus defining a plurality of discrete pitch positions.

In accordance with another aspect, an ice skate chassis having adjustable pitch is provided. The ice skate chassis comprises an elongate skate blade and a bladeholder. The blade has an elongate aperture with a plurality of slots disposed at a plurality of heights relative to one another. Each of the slots has an upper and lower engagement surface. The bladeholder has an elongate kerf and a mount hole. The kerf is configured to accept a portion of the blade therein. The mount hole has at least one slot and is configured to generally align with the blade aperture so that the mount hole slot aligns with one of the aperture slots. The mount hole slot has an upper and lower engagement surface. A key is configured to fit transversely through the mount hole and aperture. The key generally engages the engagement surfaces of the aligned slots so as to lock the blade in a vertical position relative to the bladeholder.

In accordance with yet another aspect, an ice skate chassis having adjustable pitch comprises an elongate skate blade and a bladeholder. The blade has a mount aperture with a plurality of teeth extending into the aperture. The teeth are disposed at a plurality of vertical positions relative to one another. The bladeholder has an elongate kerf and a mount hole. The kerf is configured to accept a portion of the blade, and the mount hole is selectively alignable with one or more of the blade mount aperture teeth. A fastener is configured to fit transversely through the mount hole and aperture, and is further configured to engage the teeth that are aligned with the mount hole so as to hold the blade in a vertical position relative to the bladeholder. In this arrangement, the vertical position of the blade relative to the bladeholder can be adjusted between a plurality of discrete positions by selectively aligning others of the aperture teeth with the mount hole.

In accordance with a further aspect of the present invention, an ice skate chassis is provided that is adjustable between a plurality of discrete pitch positions. The chassis comprises an elongate skate blade and a bladeholder configured to receive the elongate skate blade. A mounting mechanism is provided for securing the blade to the bladeholder. The mounting mechanism is configured to selectively secure the blade only at a plurality of discrete, pre-set positions relative to the bladeholder.

In accordance with a still further embodiment, the present invention provides a method of adjusting the pitch of an ice skate chassis between discrete pitch positions. An elongate blade is provided having a mount member comprising a plurality of teeth and a plurality of slots defined between adjacent teeth. A bladeholder is also provided for holding the elongate blade. The bladeholder has an aperture that is aligned with a first slot of the blade mount member. A key extends through the bladeholder aperture and engages the first slot. The method further includes retracting the key from engagement with the first slot and moving the blade relative to the bladeholder so that a second slot is aligned with the key. The key is advanced into engagement with the second slot.

For purposes of summarizing the invention and the advantages achieved over the prior art, certain aspects and advantages of the invention have been described hereinabove. Of course, it is to be understood that not necessarily all such aspects or advantages may be achieved in accordance with any particular embodiment of the invention. Thus, for example, those skilled in the art will recognize that the invention may be embodied or carried out in a manner that achieves or optimizes one aspect or group of aspects or advantages as taught herein without necessarily achieving other advantages as may be taught or suggested herein.

All of these aspects and advantages are intended to be within the scope of the invention herein disclosed. These and other aspects of the present invention will become readily apparent to those skilled in the art in the following detailed description of the preferred embodiments having reference to the attached figures. The invention is not limited to any particular preferred embodiment(s) disclosed.

DETAILED DESCRIPTION OF THE PREFERRED EMBODIMENT

Figure 1:
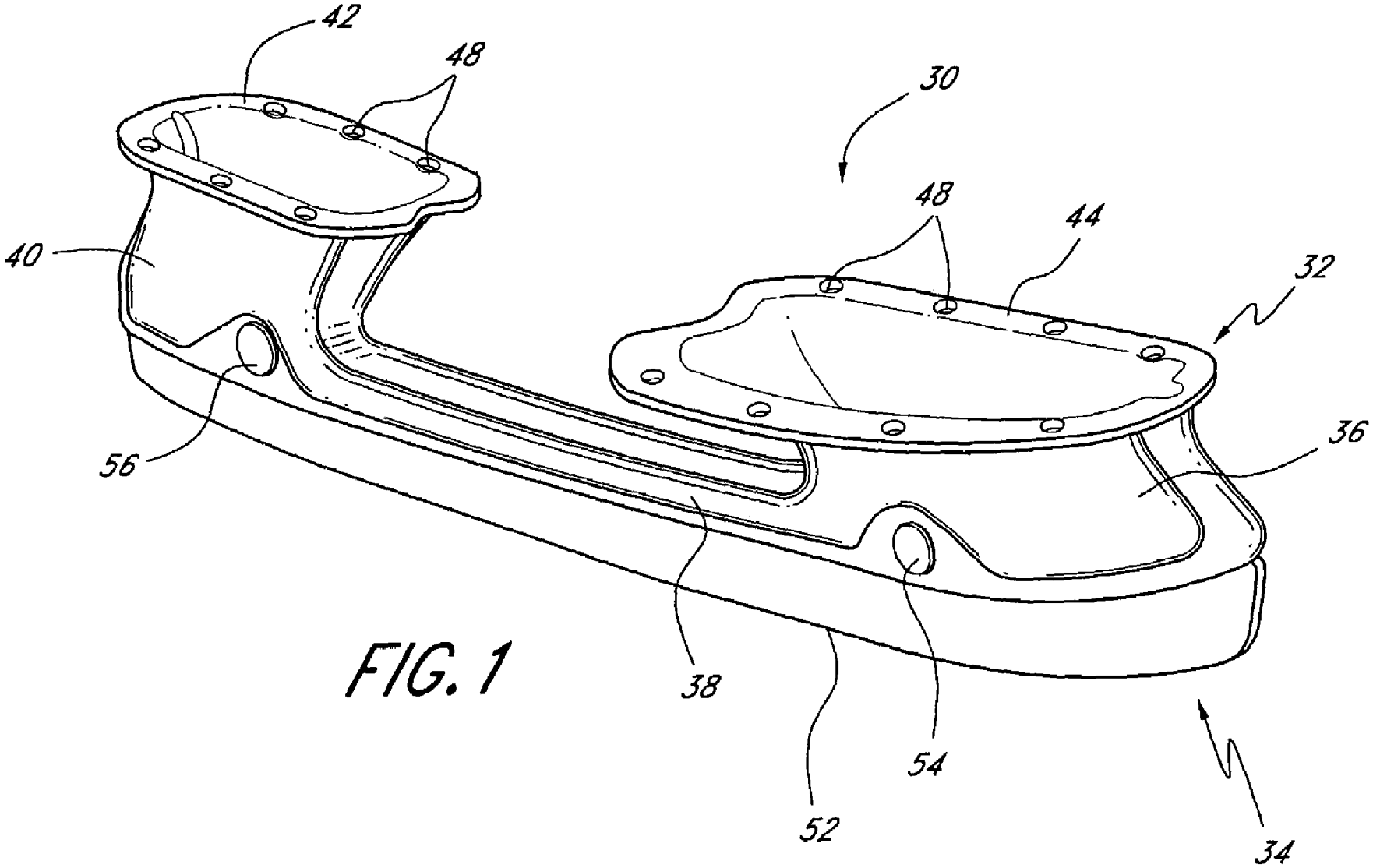
FIG. 1 is a perspective view of an ice skate chassis having features and advantages in accordance with the present invention.
Figure 2:
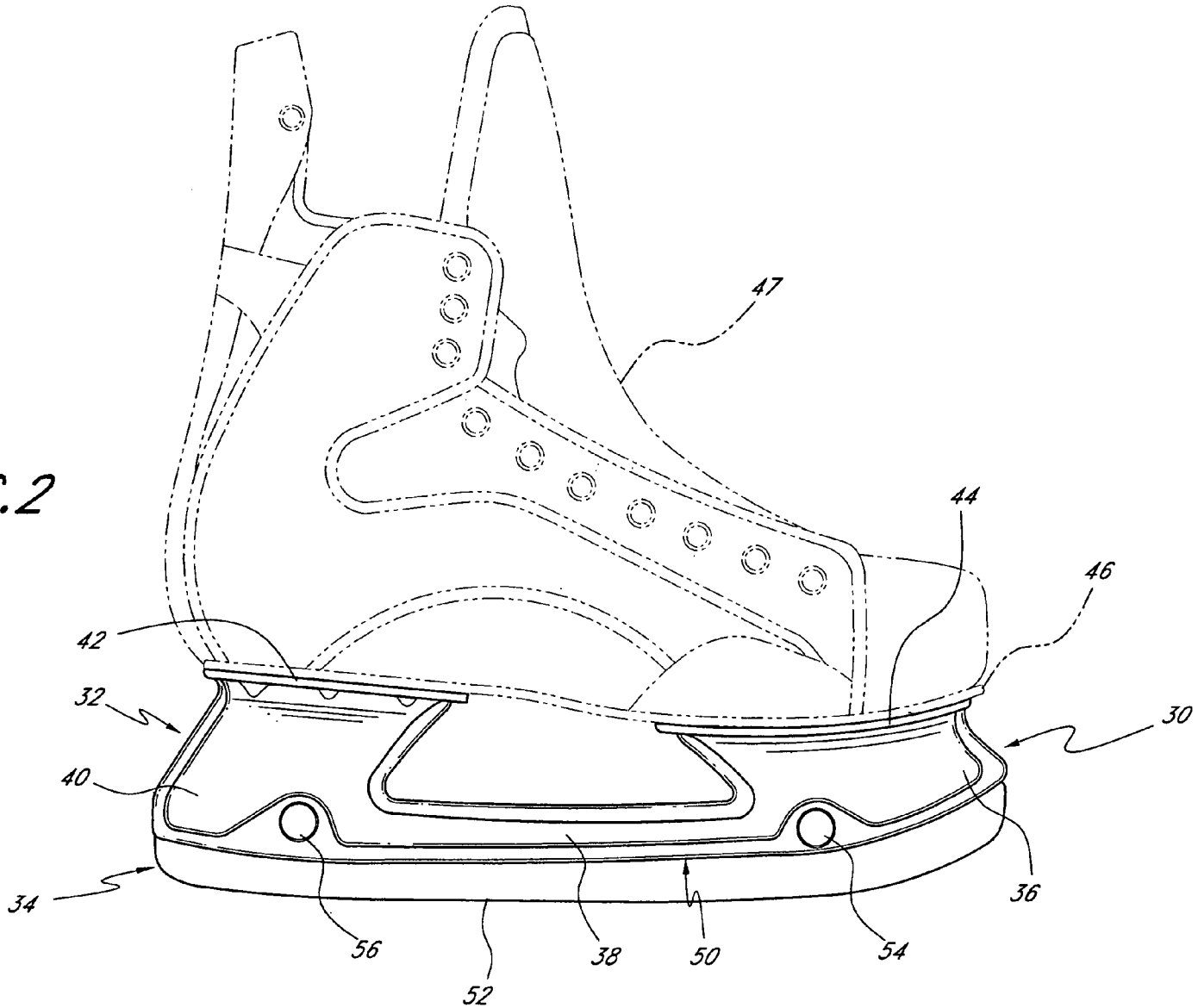
FIG. 2 is a side view of the ice skate chassis of FIG. 1, showing a skate boot in phantom.

With reference first to FIGS. 1 and 2, an ice skate chassis 30 is illustrated. The ice skate chassis 30 comprises a bladeholder 32 and an elongate ice blade or runner 34. The bladeholder 32 has a front portion 36 and a heel portion 40 that are connected by a neck 38. A heel mounting flange 42 is disposed at the top of the heel portion 40 and a front mounting flange 44 is disposed at the top of the front portion 36. Each of the mounting flanges 42, 44 is configured to engage a sole 46 of a skate boot 47 and includes a series of mount holes 48 so that the boot sole 46 can be mounted onto the bladeholder 32 with rivets, bolts or the like.

A slot or kerf 50 extends longitudinally along the bottom portion of the front 36, neck 38 and heel 40 of the bladeholder 32. The kerf 50 comprises a recess formed in the bladeholder 32. The elongate ice blade or runner 34 is configured to fit at least partially in the kerf 50 so that a portion of the blade 34 is held securely within the kerf 50 while a portion of the blade 34 extends downward out of the kerf 50 so that a bottom edge 52 of the blade can engage an ice surface. Front and rear fasteners 54, 56 connect the ice blade 34 to the chassis 30 so that the ice blade 34 is held securely within the kerf 50.

Figure 3:
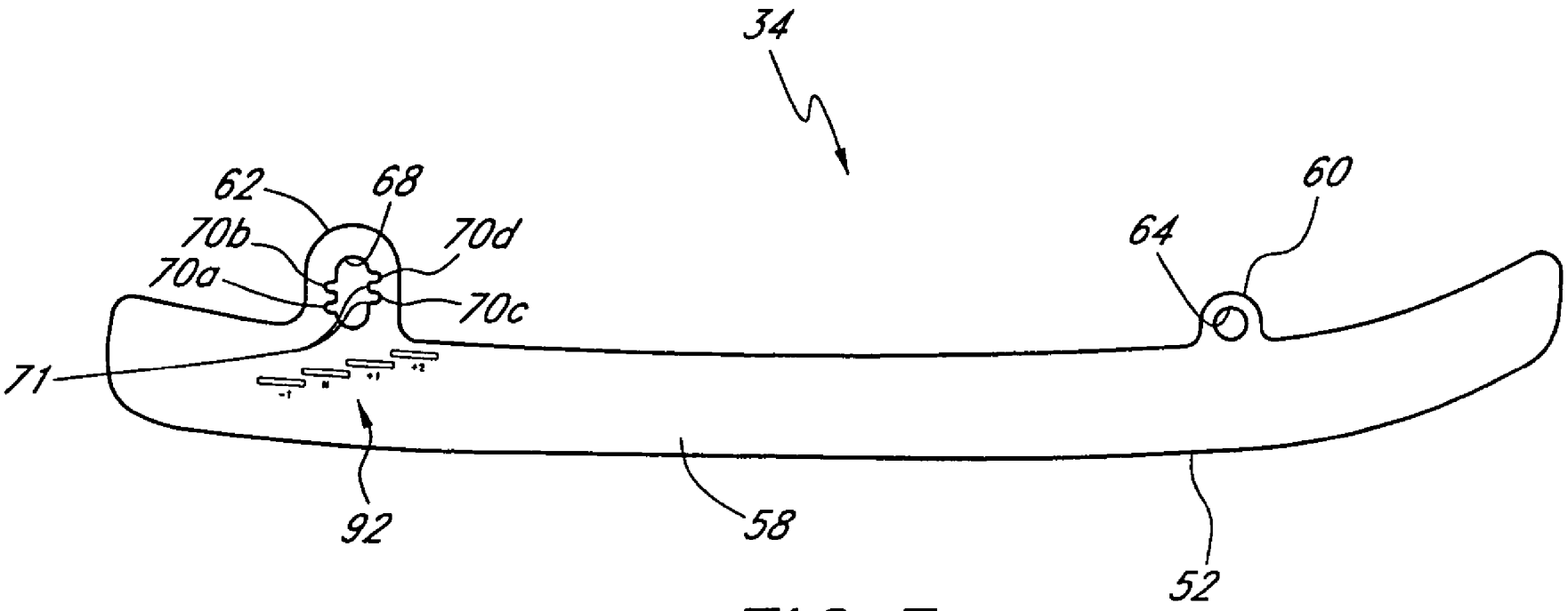
FIG. 3 is a side view of an ice skate blade having features in accordance with the present invention.
Figure 4:
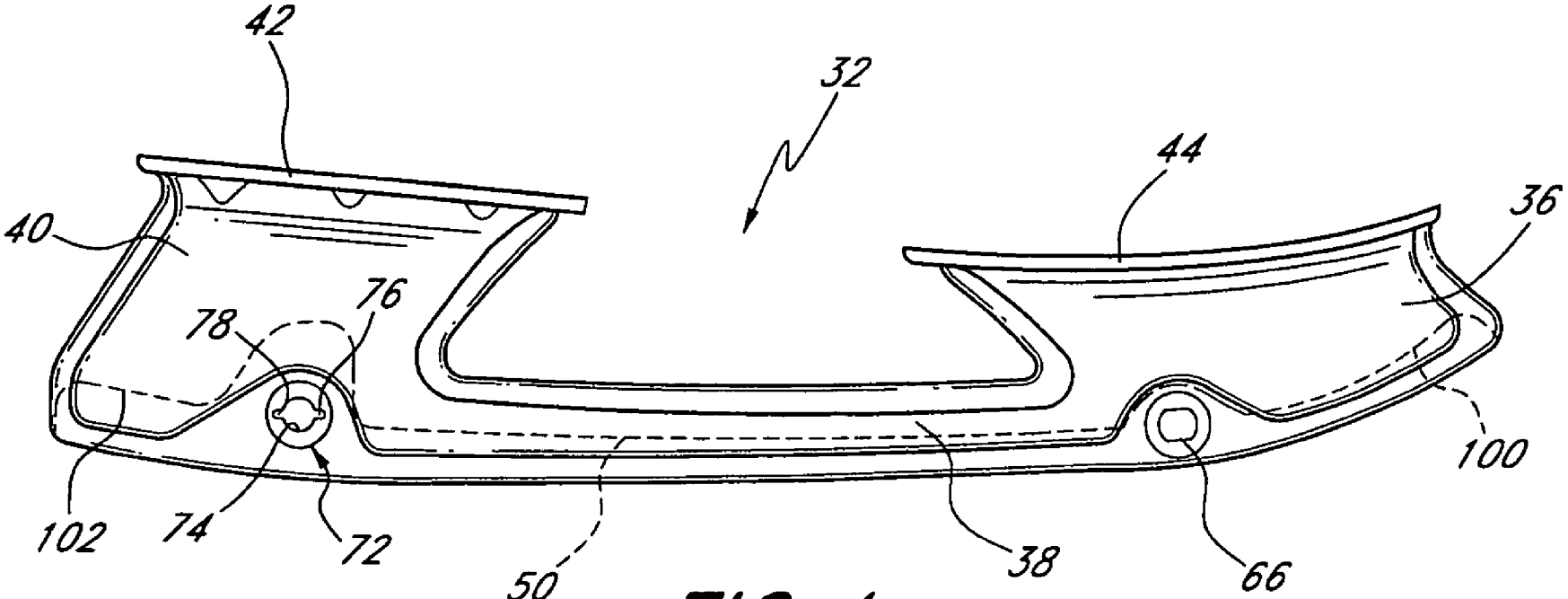
FIG. 4 is a side view of an ice skate bladeholder, shown without the corresponding blade, and showing a slot or kerf in phantom.
Figure 5:
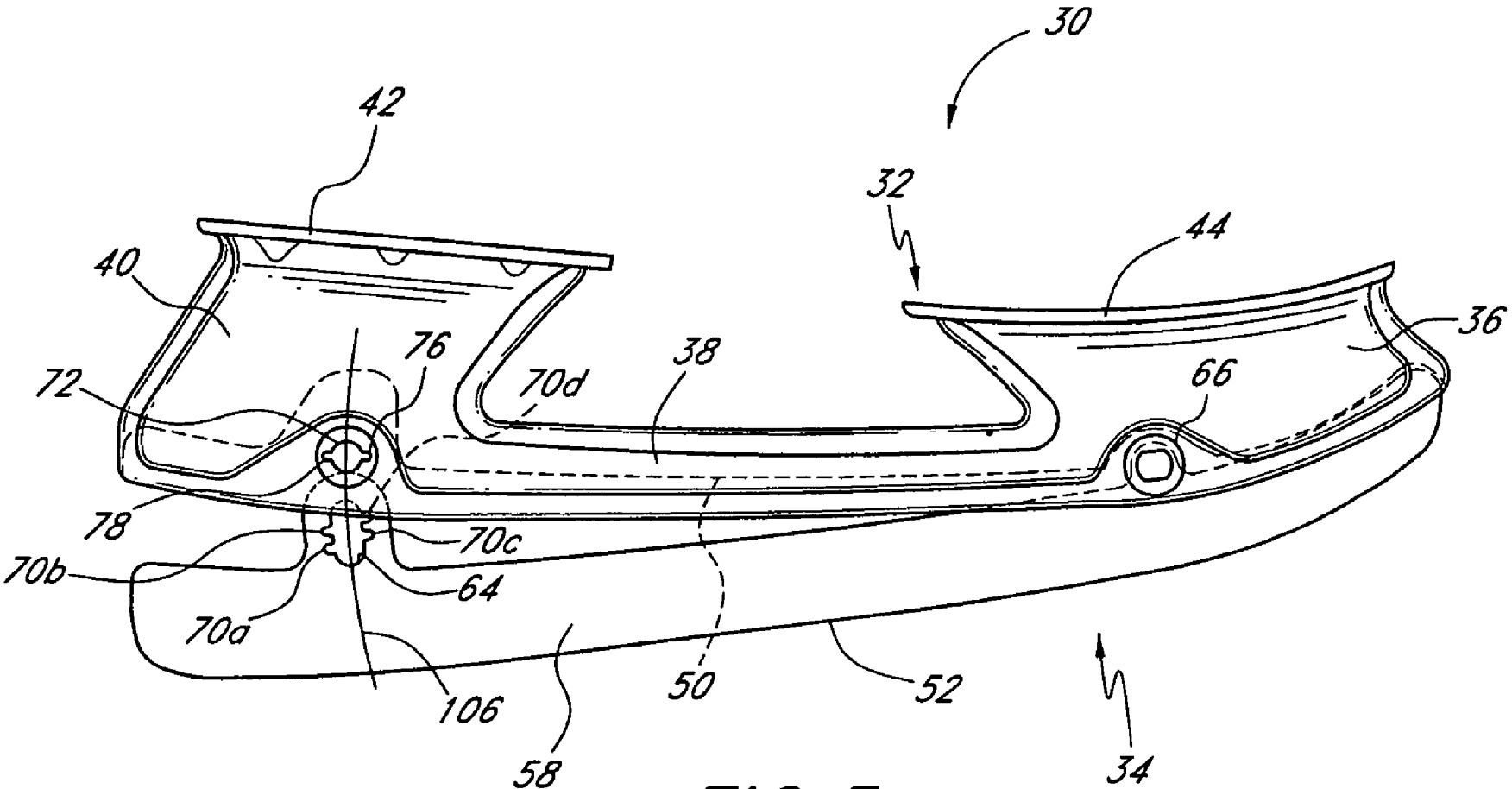
FIG. 5 shows the ice skate chassis of FIG. 4 with the blade of FIG. 3 partially attached.

With next reference to FIGS. 3-5, the blade 34 has an elongate body 58 with front and rear mounting portions 60, 62 extending upwardly from the body 58. The front mounting portion 60 includes a generally circular front mount aperture 64 that is configured to accommodate fasteners such as a bolt and nut. In the illustrated embodiment, the bladeholder 32 has a non-circular front mount hole 66. A barrel-type nut (not shown) includes an elongate shank that is shaped to complementarily fit through the non-circular front mount hole 66. As such, the nut is restrained from rotating once it is installed in the front mount hole 66. The shank is threaded internally so as to mate with a bolt. As such, the front fastener 54 can be tightened simply by tightening the bolt, and no tool is required to hold the nut in place. However, since the front mount aperture 64 of the runner 34 is generally circular, the ice blade 34 can rotate about the front fastener 54 (see FIG. 5).

The rear mount portion 62 of the runner 34 comprises a generally elongate aperture 68 having a series of cutouts or slots 70*a-d*. In the illustrated embodiment, two slots 70*c*, 70*d* are disposed along the forward edge of the aperture 68 and two slots 70*a*, 70*b* are disposed along the rearward edge of the aperture 68. The forward and rearward slots 70*a-d* are vertically staggered relative to one another. As such, each slot 70*a-d* is disposed at a different height relative to the other slots. Between and adjacent the slots 70*a-d*, the blade 34 extends inwardly, defining support members or teeth 71. The teeth 71 are sized and adapted to bear a skater's weight, as discussed in more detail below.

The rear mount aperture 68 is configured to align with a rear mount hole 72 of the bladeholder 32. In the illustrated embodiment, the rear mount hole 72 includes a generally circular portion 74 with a forwardly-extending slot 76 and a rearwardly-extending slot 78. The front and rear slots 76, 78 preferably extend generally horizontally and are disposed opposite to one another.

Figure 7:
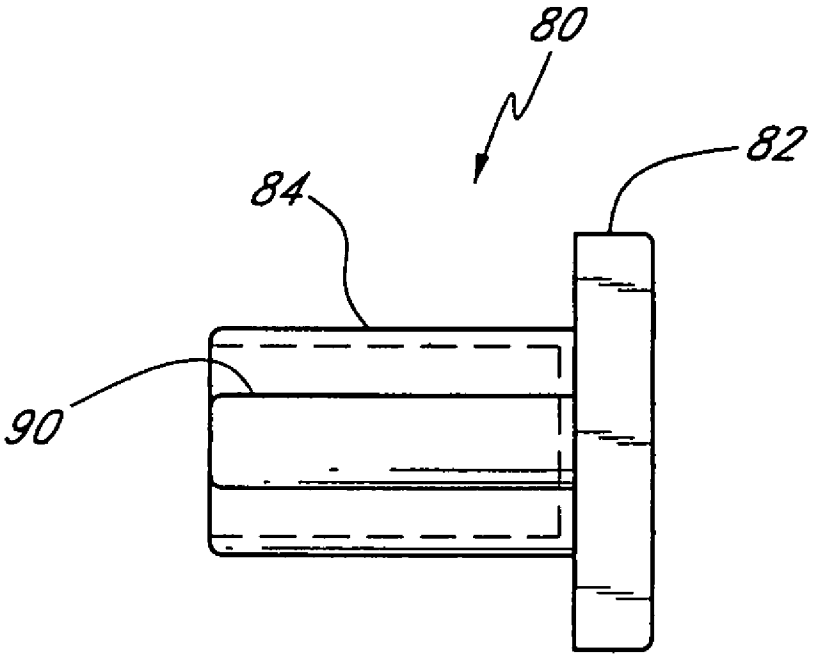
FIG. 7 is a side view of the fastener of FIG. 6.
Figure 6:
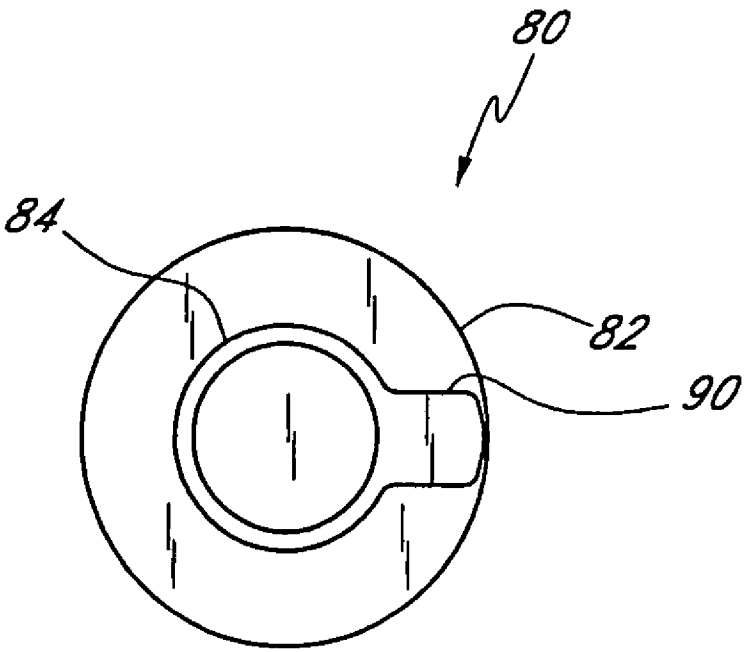
FIG. 6 is an end view of a rear fastener for use in connection with the chassis of FIG. 5.

With reference next to FIGS. 6 and 7, a nut 80 of a rear fastener 56 is illustrated. The rear nut 80 comprises a cap 82 and an elongated shank portion 84. The shank 84 is internally threaded so as to receive a bolt. A projection or key 90 extends outwardly along the length of the shank 84. The key 90 is sized and shaped to fit complementarily in the slots 70*a-d*, 76, 78 of the blade 34 and bladeholder 32.

Figure 8:
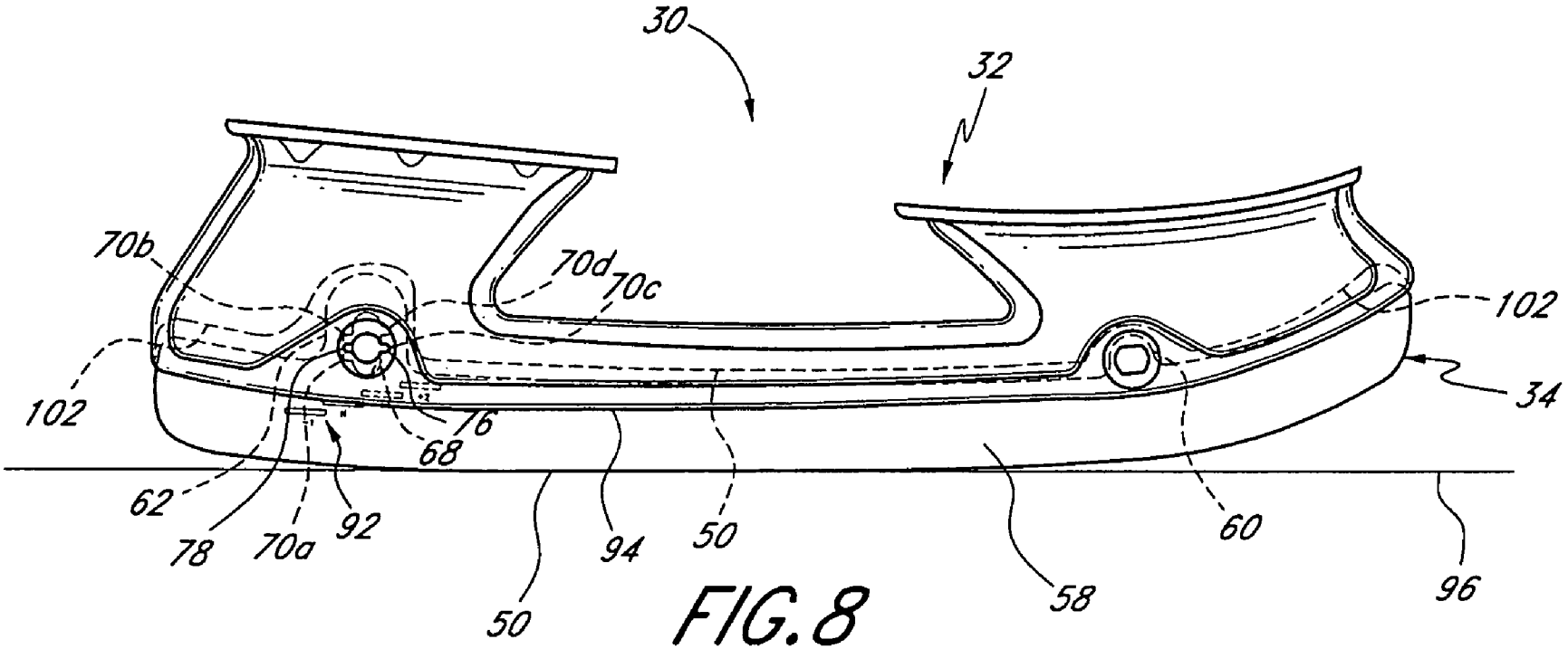
FIG. 8 is a side view of the chassis of FIG. 2 showing the blade at a neutral pitch position.
Figure 9:
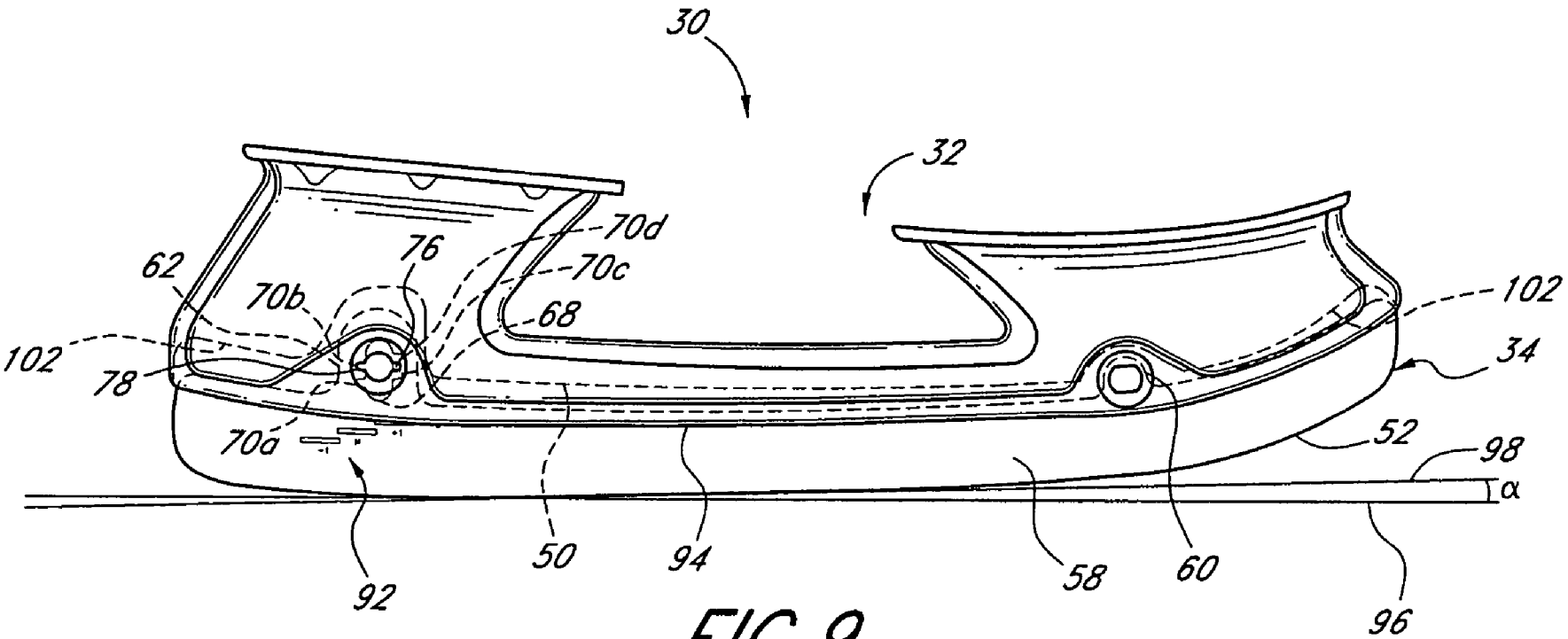
FIG. 9 is a side view of the chassis of FIG. 2 showing the blade at a forward pitch position.

With reference also to FIGS. 8 and 9, the bladeholder rear mount hole 72 and the blade rear aperture 68 are configured so that each of the aperture slots 70*a-d* can be aligned with one of the mount hole slots 76, 78. The rearward aperture slots 70*a*, 70*b* align with the rearward mount hole slot 78 and the forward aperture slots 70*c*, 70*d* align with the forward mount hole slot 76. In the illustrated embodiment, only one of the aperture slots 70*a-d* is aligned with one of the mount hole slots 76, 78 at any one time. When a mount hole slot 76, 78 and aperture slot 70*a-d* are aligned, the rear fastener nut 80 can be advanced transversely through the mount hole 72 and aperture 68 so that the key 90 fills both the aligned mount hole slot 76, 78 and aperture slot 70*a-d*. The front and rear fasteners 54, 56 can then be tightened so that the ice blade 34 is held securely by the bladeholder 32.

Engaging the nut key 90 with the aligned mount hole and aperture slots 76, 78, 70*a-d* creates a positive lock of the blade 34 relative to the bladeholder 32. This means that the blade 34 and bladeholder 32 are substantially locked in place relative to one another. More specifically, the positive lock will not allow substantial slippage or creep over time. The key 90 engages the surfaces of the teeth 71 adjacent the aligned slots 70*a-d*, 76 78 so that the teeth support the skater's weight while skating and prevent the nut 80 from sliding within the elongate aperture. This arrangement will not adjust itself or work free during the bumps, stresses, etc. of skating.

The bladeholder rear mount hole 72 and blade rear aperture 68 are configured so that the fastener key 90 can selectively engage any one of the aperture slots 70*a-d*. Since each slot 70*a-d* is disposed at a different height, the height of the rear portion of the blade relative to the front portion of the, blade depends upon which aperture slot 70*a-d* is engaged by the key 90. The skater can adjust the angle of the blade 34 relative to the bladeholder 32 by changing which aperture slot 70*a-d* is engaged. by the key 90. Changing the angle of the blade 34 relative to the bladeholder 32 correspondingly changes the overall pitch of the skate chassis 30. As such, this embodiment allows a skater to selectively adjust the skate chassis 30 between a plurality of discrete pitch positions. Additionally, each discrete pitch position is repeatable. Thus, if a skater identifies a favored pitch position, the skater can easily and quickly obtain that position even if installing a replacement blade.

With specific reference to FIGS. 3, 8 and 9, markings 92 are provided on the ice blade 34 to indicate the pitch position of the chassis 30. The markings 92 generally correspond with the position of a bottom edge 94 of the bladeholder 32 relative to the blade 34 at each of the discrete pitch positions. As such, a discrete blade pitch position is defined for each of the slots. In the illustrated embodiment, when the fastener key 90 is engaged with the first slot 70*a*, the blade 34 is positioned so that the marking labeled "−1" generally aligned with the bottom edge 95 of the bladeholder 32. In the same manner, the position corresponding to the second slot 70*c* is labeled "N" the positions for the third and fourth slots 70*b*, 70*d* correspond to labels "+1" and "+2", respectively.

FIG. 8 shows a skate chassis 32 with the blade 34 arranged so that the fastener key 90 engages the second slot 70*c* ("N" position). This position is considered "neutral." shown in FIG. 8, a tangent line 96 from the ice-engaging bottom edge 94 of the ice blade 34 is generally horizontal.

FIG. 9 represents the skate chassis 30 of FIG. 8 rearranged so that the fastener key 90 engages in the third slot 90*b*, placing the blade 34 in the "+1" position. In this arrangement, a tangent line 98 of the ice blade bottom edge 94 is angled relative to the tangent line 96 from when the chassis 30 was in the neutral ("N") position.

An angle α is defined between the tangent lines 96, 98. The angle α represents the angular difference between each of the discrete pitch positions. In the illustrated embodiment, the angle α is about ¾°. As such, the position "N" corresponds to a neutral pitch; the "+1" position corresponds to a ¾° forward pitch; the "+2" position corresponds to a 1.5° forward pitch; and the "−1" position corresponds to a ¾° rearward pitch. By allowing the user to selectively change the pitch of the skate chassis between discrete, pre-determined settings, a single skate blade can be used for a wide range of skating activities.

It is to be understood that in further embodiments the angle α between adjacent pitch positions can be any angle within a desired range. Preferably, the angle α is between about ½° and 1.5°. Further, the angle α may vary between adjacent pitch positions. For example, the angle between a first and second pitch position may be ¾°, but the angle between the second and a third pitch position may be 1°.

As discussed above, the blade 34 is moved relative to the bladeholder 32 in order to adjust the pitch of the chassis 30. In the illustrated embodiment, the kerf 50 of the bladeholder 32 is sized to accommodate such movement. For example, as shown in FIGS. 4, 5, 8 and 9, the interior recess of the kerf 50 is deeper about the front and rear kerf portions 100, 102 than in the neck. This allows for some limited rotation of the ice blade 34 about the front mount hole 66 (See FIG. 5). Additionally, the kerf 50 is deeper around the rear mount hole 72 than around the front mount hole 66 in order to accommodate the range of motion of the blade rear mount portion 62, which extends upwardly farther than the blade front mount portion 60.

With specific reference to FIG. 5, the rear aperture 68 of the ice blade 34 is slightly arcuate, following an arc 106 defined by a radius of curvature centered at the front mount aperture 64. In the illustrated embodiment, this radius of curvature is about 7". The slight arcuate shape of the rear aperture 68 helps, provide a better fit of the rear fastener 56 with the various slots 70*a-d* of the ice blade 34. It is to be understood that, in other embodiments, the distance between the front and rear mount portions 60, 62 can be varied. and the associated radius of curvature can also be varied. Additionally, the aperture 68 can be generally straight.

Figure 10:
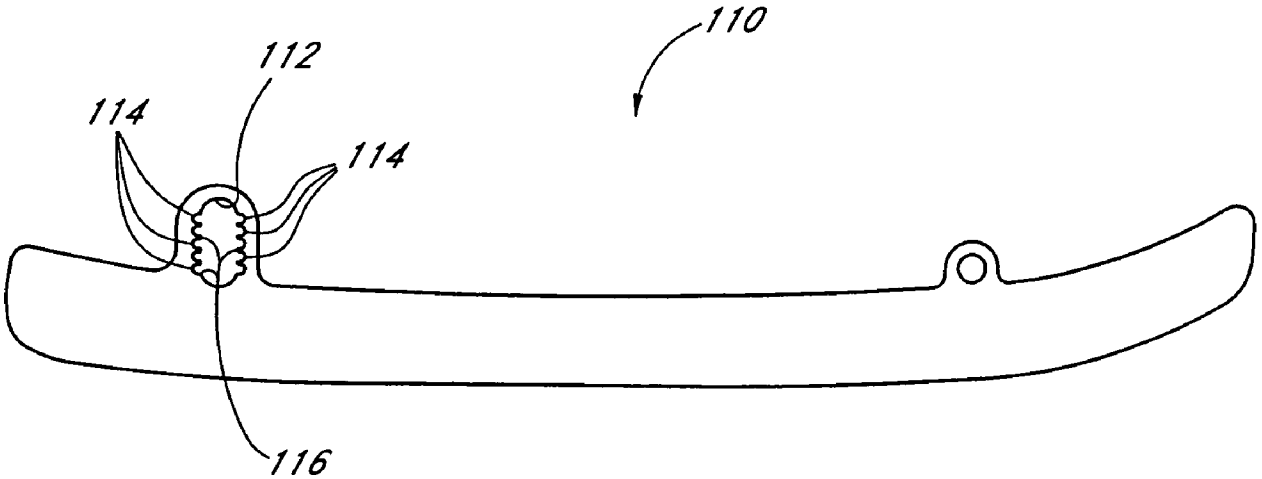
FIG. 10 is a side view of another embodiment of an ice skate blade.

It is to be understood that any manner or method and apparatus for defining a plurality of discrete pitch positions of a blade can be used in accordance with embodiments of the present invention. For example, with next reference to FIG. 10, another embodiment of a skate blade 110 is provided having an elongate rear aperture 112 with several staggered slots 114 and teeth 116 formed therein. The blade 10 has more staggered slots 114 than were provided in the blade 34 discussed above with reference to FIG. 3. The slots 114 and teeth 116 define several discrete pitch positions. It is to be understood that additional embodiments can provide any desired number of discrete positions as desired by a skater and as allowed by the size or configuration of the skate blade.

Figure 11:
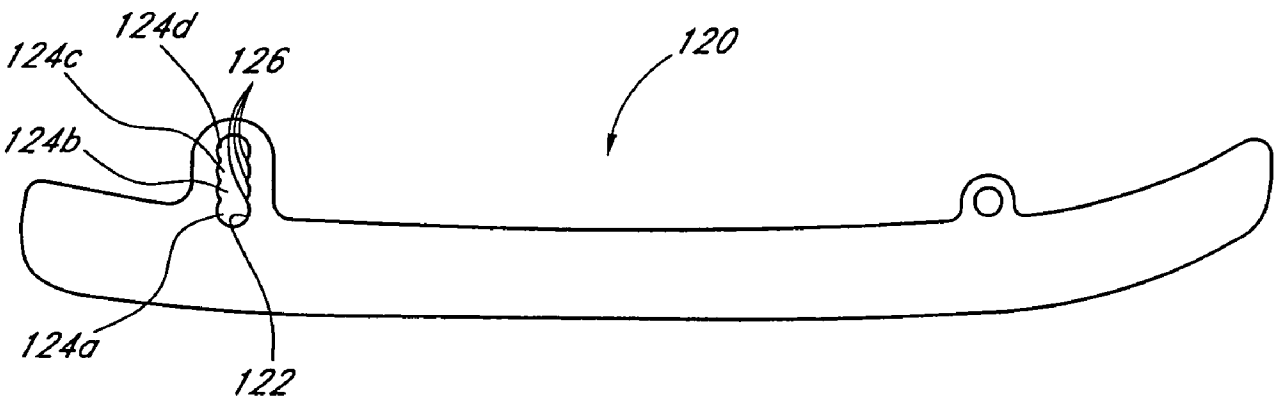
FIG. 11 is a side view of yet another embodiment of an ice skate blade.
Figure 12:
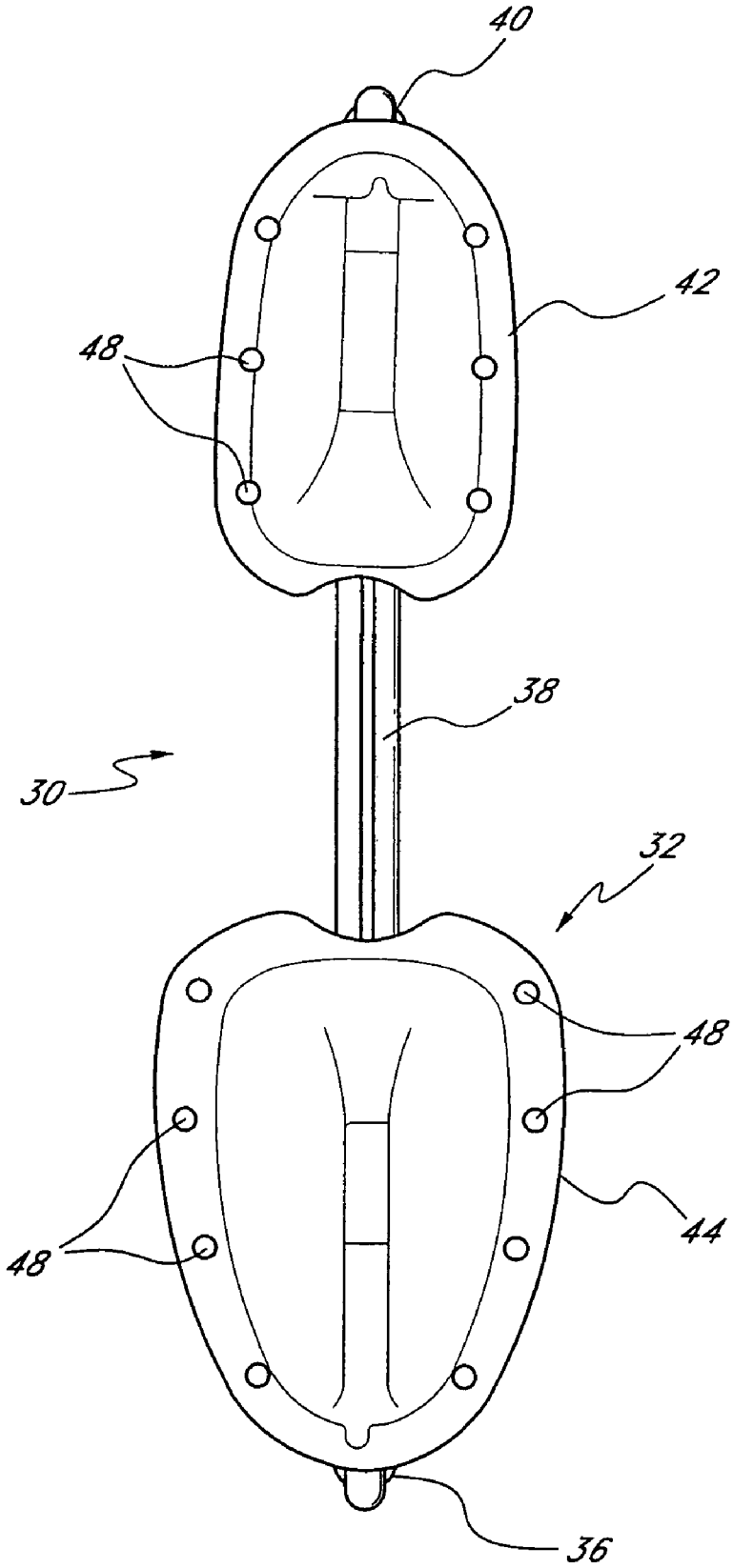
FIG. 12 is a top view of the ice skate chassis of FIG. 1.
Figure 13:
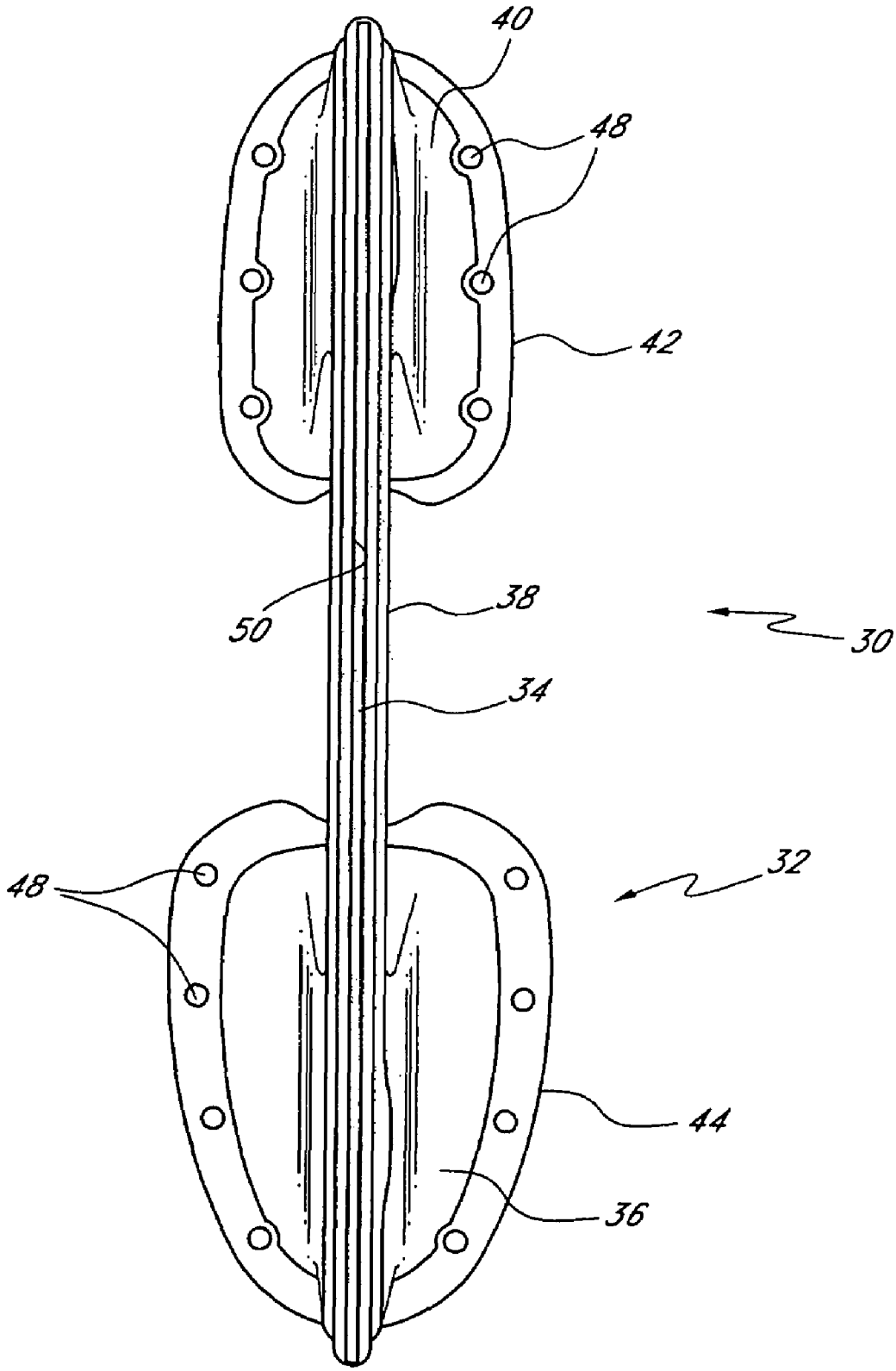
FIG. 13 is a bottom view of the ice skate chassis of FIG. 1.
Figure 14:
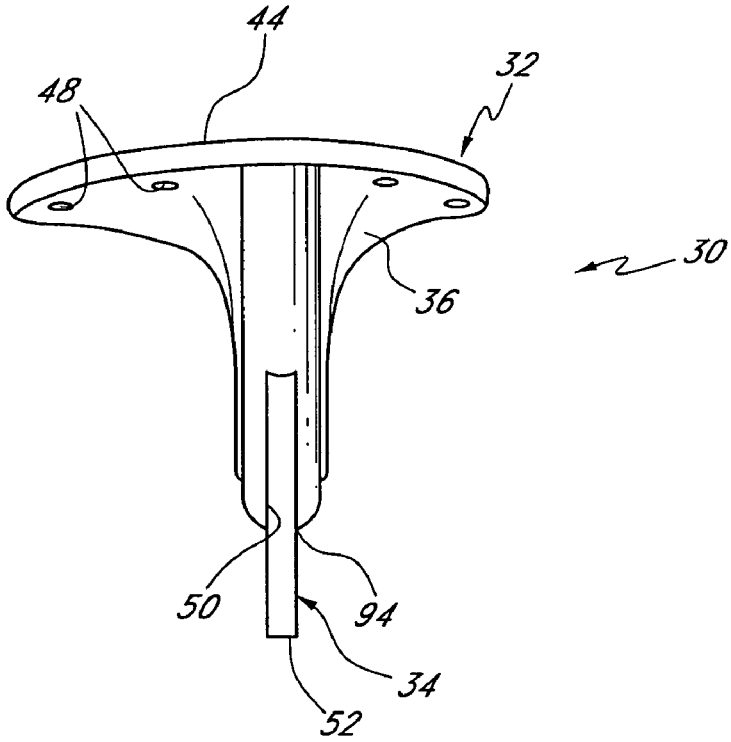
FIG. 14 is a front view of the ice skate chassis of FIG. 1.
Figure 15:
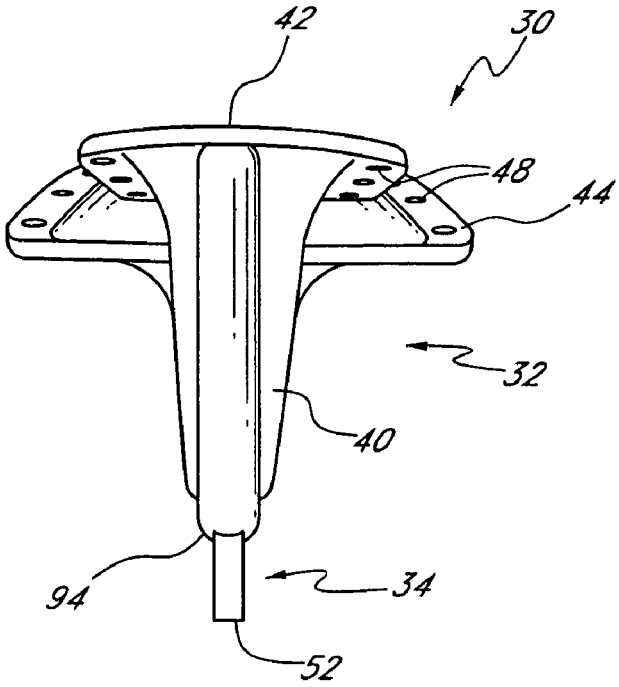
FIG. 15 is a back view of the ice skate chassis of FIG. 1.

With reference next to FIG. 11, yet another embodiment of an ice skate blade 120 is provided. In this embodiment, an elongate rear aperture 122 of the ice blade 120 comprises four generally circular fastener holds 124*a-d* defined by teeth or ridges 126 that extend partially into the aperture 122. In this embodiment, the rear mount hole of the associated bladeholder is simply a typical round hole. A fastener such as a circular barrel nut, bolt or the like is extended transversely through the bladeholder mount hole and one of the aperture holds 124*a-d*. The ridges engage the fastener to support the skater's weight and prevent the fastener from slipping from one hold position to another during skating. As such, selectively engaging the fastener in any one of the holds 124*a-d* positively locks the blade and bladeholder at the pitch position associated with that hold.

It is to be understood that, in other embodiments, various shapes and sizes of apertures, slots, fasteners, keys and bladeholder holes can be employed. For example, in another embodiment, slots in the front and rear edges of the aperture are not staggered, and the nut fastener may have two keys to engage two slots simultaneously.

The term "slot" used throughout this specification as a broad term generally referring to an indentation, cutout or the like having any appropriate shape or size for satisfying its function of engaging a key, projection, engagement member or the like. As such, the term "slot" should be interpreted broader than its normal meaning in the art, and should not be restricted to any preconception of shape, configuration or size. Similarly, the terms "teeth" and "tooth" should not be restricted to any preconception of shape, configuration or size. These terms are used throughout the specification, and refer to portions between and adjacent slots.

It is further to be understood that each of the slots can be labeled by embossing, printing, coloring or the like in order to help the user identify which slot to align with the bladeholder mount hole to achieve a desired pitch of the skate.

Figure 16:
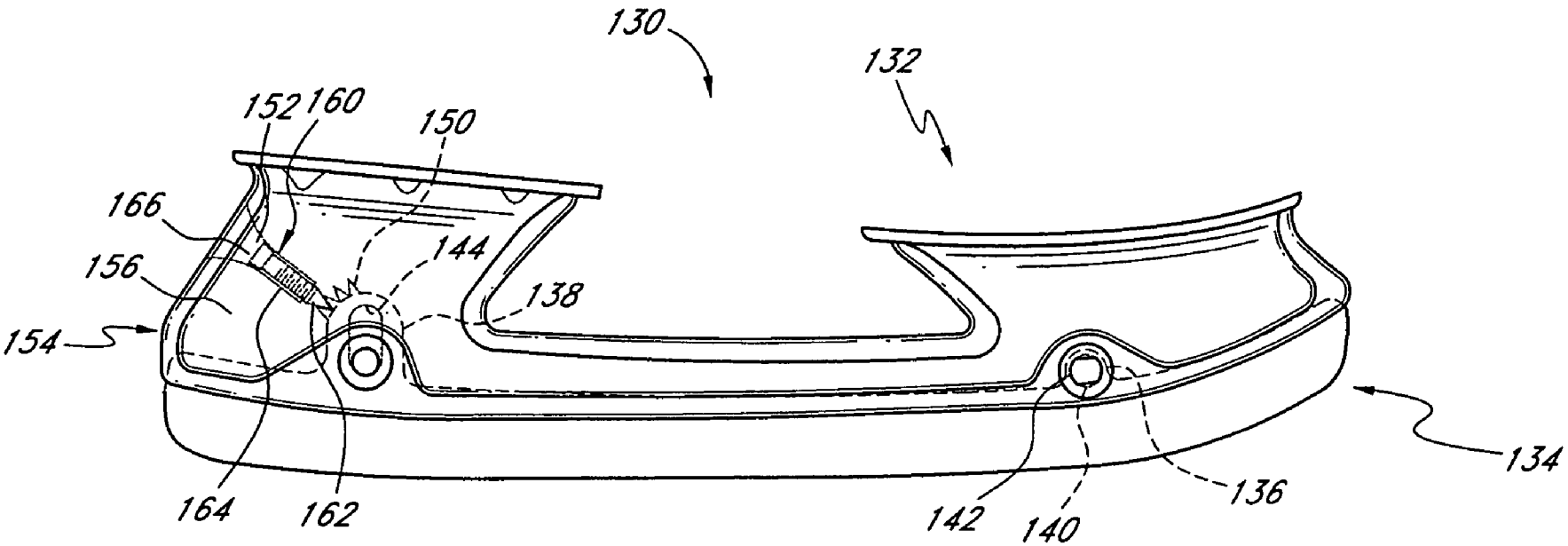
FIG. 16 is a side view of another embodiment of an ice skate chassis having adjustable pitch.

With reference next to FIG. 16, another embodiment of an ice skate chassis 130 has an ice blade or runner 134 mounted in a bladeholder 132. The runner 134 has front and rear mounting portions 136, 138. A front mount aperture 140 in the front mount portion 136 is generally circular so that the runner 134 is generally rotatable over a limited range of motion when the front mount 136 is engaged with a front mount hole 142 of the bladeholder 132. The rear mount portion 138 has an elongate aperture 144 which can accommodate fasteners over a range of positions. A plurality of teeth 150 extend from the rear mount portion 138.

A recess 152 is formed through a rear side 154 of a rear portion 156 of the bladeholder 132. The recess 152 is configured to hold an elongate adjustment mechanism 160. The adjustment mechanism 160 comprises an engagement portion 162, a threaded portion 164, and a control portion 166. The engagement portion 162 is configured to selectively engage one or more of the teeth 150 of the ice blade rear mount portion 138, as shown in FIG. 16. The threaded portion 164 engages corresponding threads formed in the bladeholder recess 152 so that the engagement portion 162 can be advanced into and out of engagement with the teeth 150. The control portion 166 is configured so that a user can twist the adjustment mechanism 160 in order to advance or retreat the mechanism 160 so that the engagement portion 162 is selectively placed into or out of engagement with the teeth 150. The control portion 166 is configured so that an Allen key, screwdriver or the like can engage the control portion to twist the adjustment device.

In operation, the engagement portion is first withdrawn from engagement with the teeth 150 and the fasteners loosened so that the blade 134 can be rotated to a desired pitch position. The device 160 is then advanced so that the engagement portion 162 engages the teeth 150. This holds the blade 134 at a desired pitch position. The fasteners are then tightened so that the combination of the fasteners and the engagement mechanism 160 positively locks the ice blade 134 securely in the bladeholder 132 at the desired pitch position.

In the embodiment illustrated in FIG. 16, the teeth 50 of the ice blade 134 and the engagement portion 162 of the bladeholder 132 together define a plurality of discrete angular positions of the blade 134 relative to the holder 132. Thus, this embodiment provides a plurality of discrete pitch positions that can be changed as desired by a user. It is to be understood that other methods and apparatus can be used to urge the engagement portion into and out of engagement with the teeth.

The ice blade in each of the above-described embodiments preferably is made of a stainless steel material that is durable and can maintain a sharp edge. It is to be understood, however, that various arrangements and materials for ice blades can be used. Additionally, the above-described bladeholders preferably are constructed of a lightweight, strong material such as nylon. However, it is to be understood that other materials, such as metal, can also be used. Additional materials also provide advantages for further embodiments. For example, a bladeholder can be constructed from a transparent or translucent material such as Xylac™, which is available from General Electric, or any type of translucent or transparent polycarbonate or other polymer. Such materials will enable the user to view the pitch adjustment mechanism in order to make pitch adjustment even more simple. Additionally, the ice blade rear mount portion can be color coded or otherwise labeled so that a user can directly view the label through the transparent or translucent bladeholder while adjusting the pitch of the skate chassis. The entire bladeholder can be translucent or transparent or, in other embodiments, only a portion of the bladeholder adjacent to the pitch adjustment mechanism can be translucent or transparent.

Although embodiments discussed above depict the ice blade as rotatable about a front mount portion and having a rear mount portion with discrete mounting positions, it is to be understood that, in still further embodiments, this arrangement can be reversed or otherwise modified. For example, the front mount portion can have a plurality of discrete mounting positions and the blade can be rotatable about the rear mount portion. Additionally, further embodiments can allow adjustment about discrete mounting positions in both the front and back of the skate chassis. Such embodiments are more complex but enable even greater customization of the position of the blade relative to the bladeholder.

The embodiments discussed above are directed to an ice hockey skate chassis. It is to be understood that skate chassis for other types of skates such as, for example, figure skates and in-line roller skates, can have features as discussed above. For example, an in-line roller chassis can have a front pivot point and a rear adjustment mechanism enabling a user to adjust the pitch of the chassis between pre-set discrete pitch positions.

Although this invention has been disclosed in the context of certain preferred embodiments and examples, it will be understood by those skilled in the art that the present invention extends beyond the specifically disclosed embodiments to other alternative embodiments and/or uses of the invention and obvious modifications and equivalents thereof. In addition, while a number of variations of the invention have been shown and described in detail, other modifications, which are within the scope of this invention, will be readily apparent to those of skill in the art based upon this disclosure. It is also contemplated that various combinations or subcombinations of the specific features and aspects of the embodiments may be made and still fall within the scope of the invention. Accordingly, it should be understood that various features and aspects of the disclosed embodiments can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. An ice skate chassis adjustable between a plurality of discrete pitch positions, comprising:

an elongate skate blade;

a bladeholder configured to receive the elongate skate blade; and a mounting mechanism for securing the blade to the bladeholder, the mounting mechanism configured to selectively secure the blade only at a plurality of discrete, pre-set positions relative to the bladeholder.

2. The ice skate chassis of claim 1, wherein the chassis has a neutral pitch position, at least one forward pitch position, and at least one rearward pitch position.

3. The ice skate chassis of claim 1, wherein the bladeholder comprises an elongate kerf configured to accept at least a portion of the skate blade, and at least a portion of the mounting mechanism is disposed within the bladeholder.

4. The ice skate chassis of claim 3, wherein the bladeholder comprises a transparent or translucent material configured so that a user can view the portion of the mounting mechanism disposed within the bladeholder.

5. The ice skate chassis of claim 1, wherein an angle of the blade relative to the bladeholder varies within the range of from about ½° to about 1½° between adjacent discrete pitch positions.

6. The ice skate chassis of claim 5, wherein the angle of the blade relative to the bladeholder varies about ¾° between adjacent discrete pitch positions.

7. An ice skate comprising an ice skate chassis as set out in claim 1 in combination with a skate boot, wherein the ice skate chassis is mounted onto the skate boot.

8. An ice skate chassis, comprising:

an elongate skate blade having a longitudinal axis and comprising a mount portion, the mount portion of the skate blade comprising a first slot and a second slot;

a bladeholder having an elongate kerf configured to accept at least part of the skate blade mount portion when the skate blade is installed in the bladeholder; and a blade angle adjustment mechanism, the adjustment mechanism being configured to selectively engage one of the skate blade slots and simultaneously engage the bladeholder;

wherein when the skate blade is installed in the bladeholder with the adjustment mechanism engaging the first skate blade slot, the skate blade longitudinal axis is at a first angle relative to the bladeholder, and when the skate blade is installed in the bladeholder with the adjustment mechanism engaging the second skate blade slot, the skate blade longitudinal axis is at a second angle relative to the bladeholder.

9. The ice skate chassis of claim 8, wherein the adjustment mechanism comprises a tooth, and the tooth is configured to selectively engage one of the skate blade slots.

10. The ice skate chassis of claim 9, wherein the mount portion of the skate blade comprises a front aperture and a rear aperture, and the bladeholder comprises front and rear apertures configured to align with the skate blade front and rear apertures.

11. The ice skate chassis of claim 10 additionally comprising front and rear fasteners configured to fit through the aligned front and rear apertures of the skate blade and bladeholder so as to secure the blade to the bladeholder.

12. The ice skate chassis of claim 11, wherein at least one of the blade apertures is elongate.

13. The ice skate chassis of claim 12, wherein the front blade aperture is elongate.

14. The ice skate chassis of claim 12, wherein the rear blade aperture is elongate.

15. The ice skate chassis of claim 12, wherein the first and second slots are arranged in or adjacent the elongate blade aperture.

16. The ice skate chassis of claim 15, wherein the fastener that is configured to fit in the elongate blade aperture comprises the adjustment mechanism.

17. The ice skate chassis of claim 16, wherein at least one slot is formed in the bladeholder, and the adjustment mechanism engages the bladeholder slot and at least one of the skate blade slots.

18. The ice skate chassis of claim 12, wherein the first and second slots are arranged on the skate blade and are spaced from the elongate blade aperture.

19. An ice skate comprising an ice skate chassis as set out in claim 9 in combination with a skate boot, wherein the ice skate chassis is mounted onto the skate boot.

20. An ice skate chassis, comprising:

an elongate skate blade having a mount portion comprising first and second mounts;

a bladeholder having an elongate kerf configured to accept at least part of the skate blade mount portion when the skate blade is installed in the bladeholder;

a fastening mechanism for attaching the first and second mounts of the skate blade to the bladeholder;

a plurality of slots disposed in at least one of the bladeholder and skate blade; and a blade angle adjustment mechanism, the adjustment mechanism being configured to simultaneously engage the skate blade and the bladeholder to define an angular position of the skate blade relative to the bladeholder, the adjustment mechanism being adapted to selectively engage one of the plurality of slots disposed in at least one of the bladeholder and skate blade so as to selectively position the blade at one of a plurality of discrete, pre-set positions relative to the bladeholder.

21. The ice skate chassis of claim 20, wherein the adjustment mechanism is configured to simultaneously engage the skate blade and a slot in the bladeholder.

22. The ice skate chassis of claim 21, wherein the adjustment mechanism is configured to simultaneously engage a slot in the skate blade and a slot in the bladeholder.

23. The ice skate chassis of claim 21, wherein the bladeholder comprises a plurality of slots.

24. The ice skate chassis of claim 21, wherein the skate blade comprises a plurality of slots.

25. The ice skate chassis of claim 20, wherein the fastening mechanism comprises first and second mount fasteners that secure the blade to the bladeholder.

26. The ice skate chassis of claim 25, wherein the angle adjustment mechanism is spaced from the fastening mechanism.

27. The ice skate chassis of claim 25, wherein at least one of the first and second mount fasteners comprises the angle adjustment mechanism.

28. An ice skate comprising an ice skate chassis as set out in claim 21 in combination with a skate boot, wherein the ice skate chassis is mounted onto the skate boot.

* * * * *

UNITED STATES PATENT AND TRADEMARK OFFICE

CERTIFICATE OF CORRECTION

PATENT NO. : 7,523,947 B2
APPLICATION NO. : 11/052531
DATED : April 28, 2009
INVENTOR(S) : Tan Pham et al.

It is certified that error appears in the above-identified patent and that said Letters Patent is hereby corrected as shown below:

In column 1, line 7, change "6,851,68," to --6,851,680,--.

In column 1, line 24-25, change "roller-skates," to --roller skates,--.

In column 5, line 19, change "the," to --the--.

In column 5, line 23, change "engaged." to --engaged--.

In column 5, line 40, after ""-1"" insert --is--.

In column 5, line 42, change ""N"" to --"N", and--.

In column 5, line 47, after ""neutral."" insert --As--.

In column 6, line 24, change "helps," to --helps--.

In column 6, line 27, change "varied." to --varied--.

In column 6, line 64, after ""slot"" insert --is--.

Signed and Sealed this

Twenty-sixth Day of January, 2010

David J. Kappos

David J. Kappos
*Director of the United States Patent and Trademark Office*